US006048281A

United States Patent [19]

Place et al.

[11] Patent Number: 6,048,281

[45] Date of Patent: Apr. 11, 2000

[54] SPORT TRAINING TENSION DEVICE

[76] Inventors: Nathan A. Place; Alan H. Place, both of 1995 Penny Royal La., Wentzville, Mo. 63385

[21] Appl. No.: 09/218,666

[22] Filed: Dec. 22, 1998

[51] Int. Cl.[7] ..... A63B 61/00

[52] U.S. Cl. ..... 473/425; 482/121

[58] Field of Search ..... 473/422–424, 473/425, 415, 604, 490, 459, 524; 206/278; D08/331; 280/801.1; 482/121, 122, 124, 126

[56] References Cited

U.S. PATENT DOCUMENTS

| | | | |
|---|---|---|---|
| 3,937,465 | 2/1976 | Roland | 273/29 A |
| 4,095,787 | 6/1978 | Saferstein | 473/423 |
| 4,150,821 | 4/1979 | Racz | 273/29 A |
| 4,519,608 | 5/1985 | Gilly | 273/29 A |
| 4,909,232 | 3/1990 | Carella | 124/35 A |
| 4,955,608 | 9/1990 | Dougherty et al. | 482/121 |
| 5,188,366 | 2/1993 | Dorotinsky et al. | 482/124 |
| 5,257,779 | 11/1993 | Dalbo | 273/29 A |
| 5,439,214 | 8/1995 | Dalbo | 273/29 A |
| 5,618,040 | 4/1997 | Parten | 473/461 |
| 5,873,805 | 2/1999 | Ayres et al. | 482/121 |
| 5,924,933 | 7/1999 | Pacheco | 473/216 |

*Primary Examiner*—Jeanette Chapman
*Assistant Examiner*—Mitra Aryanpour
*Attorney, Agent, or Firm*—Henderson & Sturm LLP

[57] ABSTRACT

A sports training tension device that utilizes interchangeable attachment connectors for attaching elastomeric tubing sections between a standard piece of sporting equipment, such as a tennis racket, racquetball racket, etc. and a fixed location such as a tree, post, or other item. A non-elastic strapping connector is provided between lengths of elastomeric tubing for providing additional length without additional elasticity being incorporated.

1 Claim, 1 Drawing Sheet

SPORT TRAINING TENSION DEVICE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of sports training devices, and more particularly to a tension device for standard sporting equipment.

2. Description of Related Art

As can be seen by reference to the following U.S. Pat. Nos. 3,937,465; 4,150,821; 4,519,608; 5,257,779; 5,439,214; and 5,618,040, the prior art is replete with myriad and diverse sports training devices.

While all of the aforementioned prior art constructions are more than adequate for the basic purpose and function for which they have been specifically designed, they are uniformly deficient with respect to their failure to provide a simple, efficient, and practical sports training device that uses tension to build strength while attached to a standard piece of sporting equipment such as a tennis racket.

As a consequence of the foregoing situation, there has existed a longstanding need for a new and improved sports training tension device and the provision of such a construction is a stated objective of the present invention.

BRIEF SUMMARY OF THE INVENTION

Briefly stated, the present invention provides a sports training tension device that utilizes interchangeable attachment connectors for attaching elastomeric tubing sections between a standard piece of sporting equipment, such as a tennis racket, racquetball racket, etc. and a fixed location such as a tree, post, or other item. A non-elastic strapping connector is provided between lengths of elastomeric tubing for providing additional length without additional elasticity being incorporated.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figures 1, 2:
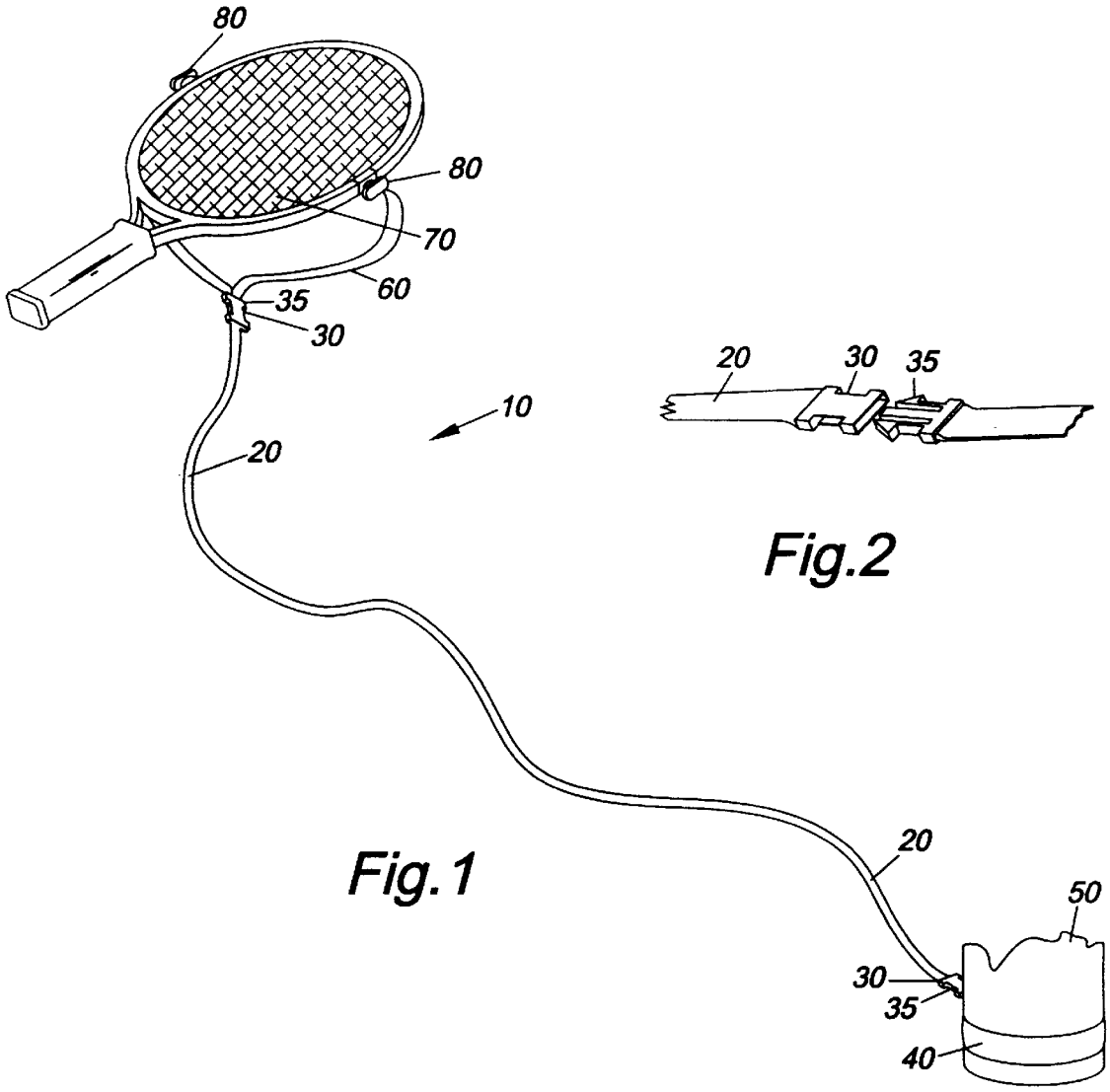
FIG. 1 is a partial perspective view showing the present invention used with a standard tennis racket.
FIG. 2 is a partial perspective view showing the connectors between the elastomeric and non-elastomeric straps.

As can be seen by reference to the drawings, and in particularly to FIG. 1, the sports training tension device that forms the basis of the present invention is designated generally by the reference number 10. The device 10 includes a strip of elastomeric material 20, such a rubber tubing, with connectors 30 attached at each end. A non-elastomeric adjustable nylon anchor strap 40 is attached to a fixed object 50, such as a tree or a pole, and includes a mating connector 35 which provides quick connection to one of the connectors 30. A non-elastomeric nylon adapter strap 60 is attached to a standard piece of sporting equipment 70, such as a tennis racket, by clamps 80. A mating connector 35 is attached to the adapter strap 60 and provides a quick connection to the other of the connectors 30.

In use, the user places the clamps 80 on the desired piece of sporting equipment 70, and attaches the appropriate adapter strap 60 to the clamps 80. The adjustable anchor strap 40 is then secured to a fixed object 50, such as a pole, and the elastomeric material 20 is attached by connectors 30, 35 to interconnect the anchor strap 40 and the adapter strap 60. The user then proceeds to practice with the chosen sporting equipment 70 as in normal use. The device 10 provides extra resistance or tension to strengthen the muscle groups which are needed to excel in the chosen sport.

The concept of the device 10 is that of a system of tension equipment which improves various sporting strengths such as tennis, racquet ball, football, and many other sports.

The device 10 utilizes interchangeable adapter straps 60 which are used in a variety of ways. The interchangeable pieces of sports equipment 70 are used for strengthening arms and shoulders when training for tennis while it could also be used as a muscular rehabilitation system. The device 10 can be used in the home, in rehabilitation clinics, colleges, and high school and athletic training rooms.

The elastic rubber tubing 20 is similar to the tubing currently used for tension systems in muscle strengthening. The rubber tubing 20 incorporates connectors 30 at both ends, allowing the user to attach a variety of adapters 60. The adapters 60 may accommodate a variety of sports such as tennis, racquetball, football, baseball, and handball, etc. The device 10 may also include a leg and thigh pad to assist in working out different muscle groups in the legs. The connectors 30, 35 are designed of plastic.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

We claim:

1. A sports tension device for attachment to a standard piece of sporting equipment consisting of:

an elongated strip of elastomeric material having free ends;

connectors attached to the free ends of the strip;

an anchor strap attached to a fixed object;

a first mating connector attached to the anchor strap and being disposed to selectively engage one of the connectors on the strip;

an adapter strap attached to the standard piece of sporting equipment;

a second mating connector attached to the adapter strap and being disposed to selectively engage the other of the connectors on the strap;

wherein the strip of elastomeric material is a rubber tubing;

wherein the anchor strap is made of nylon;

wherein the adaptor strap is made of nylon;

wherein the standard piece of sporting equipment is a racket having a frame, and further including a pair of clamps attached at opposite sides of the frame, and wherein the adapter strap includes ends; one end being to attached to one of the clamps and another end being attached to another of the clamps;

wherein the second mating connector is attached to the adapter strap intermediate the ends; and wherein the anchor strap is adjustable.

* * * * *